US006585015B2

(12) United States Patent
Hughes

(10) Patent No.: US 6,585,015 B2
(45) Date of Patent: Jul. 1, 2003

(54) CONTAINER

(75) Inventor: Barney Hughes, Wilton, CT (US)

(73) Assignee: Castrol Limited, Swindon (GB)

( * ) Notice: Subject to any disclaimer, the term of this patent is extended or adjusted under 35 U.S.C. 154(b) by 0 days.

(21) Appl. No.: 10/015,940

(22) Filed: Dec. 17, 2001

(65) Prior Publication Data

US 2002/0056488 A1 May 16, 2002

Related U.S. Application Data

(63) Continuation of application No. PCT/GB00/02593, filed on Jul. 12, 2000.

(60) Provisional application No. 60/144,081, filed on Jul. 16, 1999.

(30) Foreign Application Priority Data

Oct. 4, 1999 (GB) ..... 9923336

(51) Int. Cl.[7] ..... B65B 39/00; B67C 11/04

(52) U.S. Cl. ..... 141/331; 141/2; 141/392; 222/567

(58) Field of Search ..... 141/2, 114, 319, 141/320, 329, 331, 332, 391, 392; 222/519, 520, 548, 549, 551, 567, 570

(56) References Cited

U.S. PATENT DOCUMENTS

| | | | | |
|---|---|---|---|---|
| 5,065,909 A | | 11/1991 | Pino et al. | |
| 5,259,426 A | * | 11/1993 | Burleigh et al. | 141/331 |
| 5,277,343 A | * | 1/1994 | Parsonage | 222/484 |
| 5,400,928 A | | 3/1995 | Resnick | |
| 5,897,037 A | | 4/1999 | Mann | |

FOREIGN PATENT DOCUMENTS

| | | |
|---|---|---|
| EP | 0 846 627 | 6/1998 |
| GB | 237489 | 7/1925 |
| GB | 2 275 247 | 8/1994 |

* cited by examiner

*Primary Examiner*—Timothy L. Maust
(74) *Attorney, Agent, or Firm*—Nixon & Vanderhye P.C.

(57) ABSTRACT

A container for a fuel system additive. The container comprises a sealable first part (1) for storing the fuel system additive and a second part (2) that is capable of opening a flap on a vehicle's fuel tank. the two parts are capable of relative movement which unseals the first part (1) so that the fuel system additive can leave the first part (1) and travel through the second part (2) into a vehicle's fuel tank. the container avoids or reduces spillage of the fuel system additive.

12 Claims, 3 Drawing Sheets

CONTAINER

This application is a continuation of international application PCT/GB00/02593 filed Jul. 12, 2000, which claims the benefit of Provisional application Ser. No. 60/144,081, filed Jul. 16, 1999, the entire content of which is hereby incorporated by reference in this application.

This invention concerns a container that is suitable for pouring an additive such as a fuel system additive into a vehicle's fuel tank.

Fuel system additives are available to consumers to allow them to improve the performance of their vehicles or to maintain a vehicle's performance on a regular basis. Fuel system additives include, for example, carburettor sprays, diesel fuel additives, fuel system cleaners, gas treatments, octane boosters, fuel injection cleaners, carburettor cleaners, combined fuel injection and carburettor cleaners, and dry gas and winter fuel products. The fuel system additive enters a vehicle's fuel system by being poured into a vehicle's fuel tank by a consumer.

Current fuel system additives claim to: clean carburettors and injectors; reduce intake valve deposits; remove water; fight gas line freeze; save gas; boost octane up to 7 points; improve mileage and performance; clean the entire fuel system and remove power-robbing deposits.

Current fuel system additives tend to be in liquid form and be a blend of detergents and odourless mineral spirits.

Most containers for fuel system additives tend to have a 2 to 4 inch narrow bottleneck which is designed to open the flap of a fuel tank and allow the fuel system additives to be poured into a vehicle's fuel tank. The container usually has a screw lid. The lengths of the bottlenecks vary, and so do the distances between fuel tank flaps and the side of the vehicle. Therefore a bottleneck may not always be the right size and shape for a particular vehicle. In order to use these containers, a user needs to remove the screw lid and then open the flap of the fuel tank using the open end of the bottleneck. If the user does not move quickly, the fuel system additive can be spilt on the user, on the user's clothes, on the side of the vehicle and on the ground around the vehicle. Spillage of the fuel system additive is a waste of money and reduces the benefit of the system because not all of the fuel system additive enters the fuel tank. Consumers are known to be dissatisfied with these containers and they can deter consumers from using fuel system additives.

Many consumers attempt to overcome the spillage issue by using tools or foreign objects to pry open the flap of a fuel tank before pouring the fuel system additive into the fuel tank. Some consumers use, for example, a screw driver or a stick. The fuel system additive comes into contact with the foreign object so the foreign object needs to be cleaned afterwards. Any debris on the foreign object may enter the fuel tank.

A user may also pry open the flap of a fuel tank using a funnel having a long neck. After prying open the flap with the funnel, the fuel system additive is poured into the funnel. After using the funnel, it needs to be cleaned by the user.

Qualitative research with consumers has been conducted in four US cities by the applicant and significant concerns about filling a fuel tank with a fuel system additive have been identified (Calle Research, 1999). This research also identified the methods discussed above.

The aim of the present invention is to provide a container for a fuel system additive that overcomes the problems identified above with current containers.

In accordance with the present invention there is provided a container for a fuel system additive, the container comprising a sealed first part for storing the fuel system additive and a second part that is capable of opening a flap in a vehicle's fuel tank; the two parts being capable of relative movement which unseals the first part so that the fuel system additive can leave the first part, and travel through the second part into a vehicle's fuel tank.

The first part and the second part are preferably capable of locking together so that they become one. The parts therefore preferably have interlocking members.

The first part is preferably sealed using a lid. The lid is preferably a screw-lid. The screw-lid is preferably a nut. The nut may, for example, be square or hexagonal. When the first part has a lid, the second part has a receiving member which is shaped to receive the lid and lock the two parts together.

The lid or seal on the first part is preferably child-resistant.

The second part is preferably funnel-shaped with a spout end and a wider end.

In use, a user of the container is able to unseal remotely the sealed first part containing the fuel system additive so that the fuel system additive is not spilt on to the user's hands or clothes.

The second part of the container is shaped so that it is capable of opening the flap of a fuel tank. A foreign object is therefore not required to open the flap of a fuel tank.

The first and second parts are preferably formed from moulded plastics.

The first part preferably holds 8, 12 or 16 ounces of liquid.

The container may be designed and/or manufactured for single use only.

The invention will now be described, by way of example, with reference to the following drawings in which.

Figure 1:
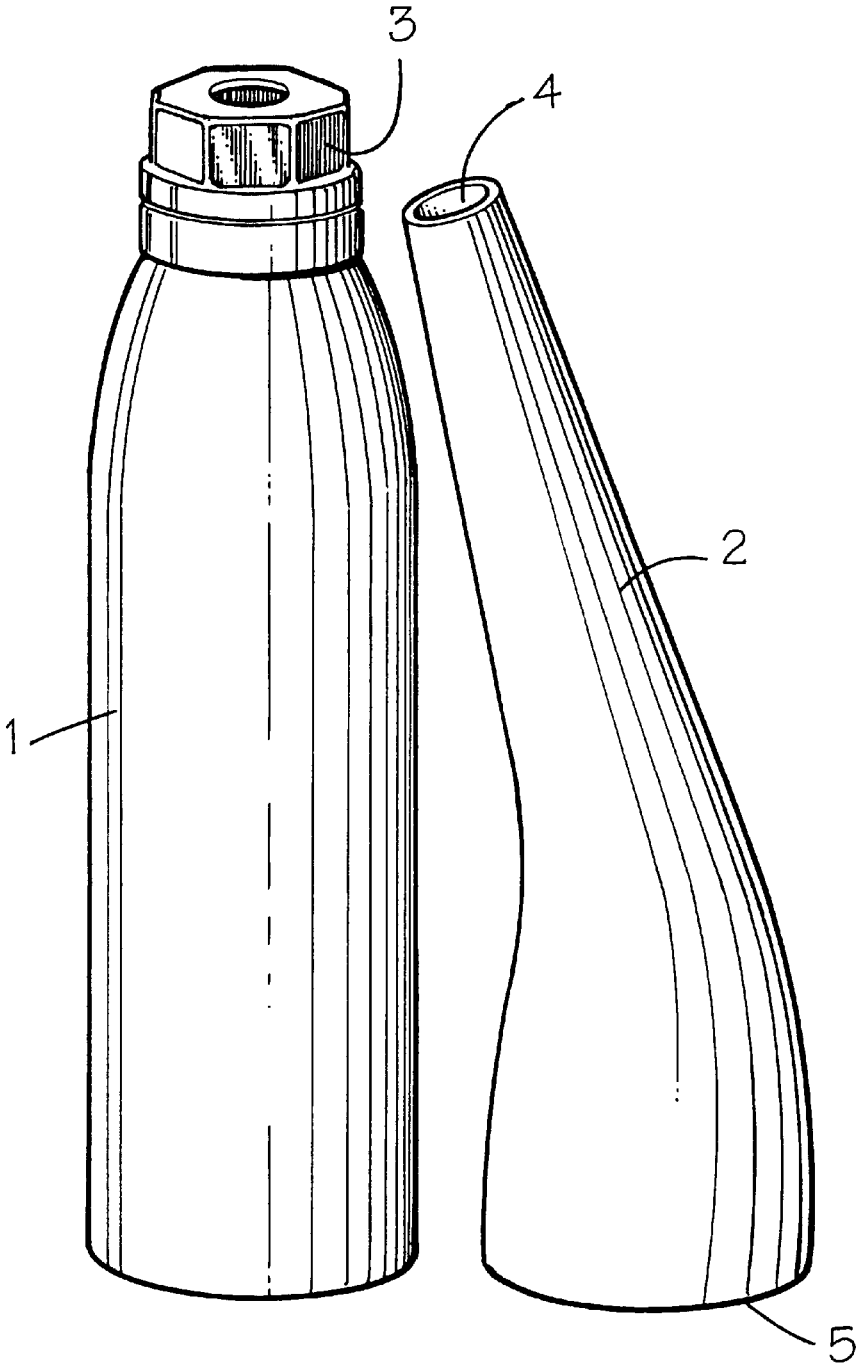
FIG. 1 shows first and second parts of the container.
Figure 2:
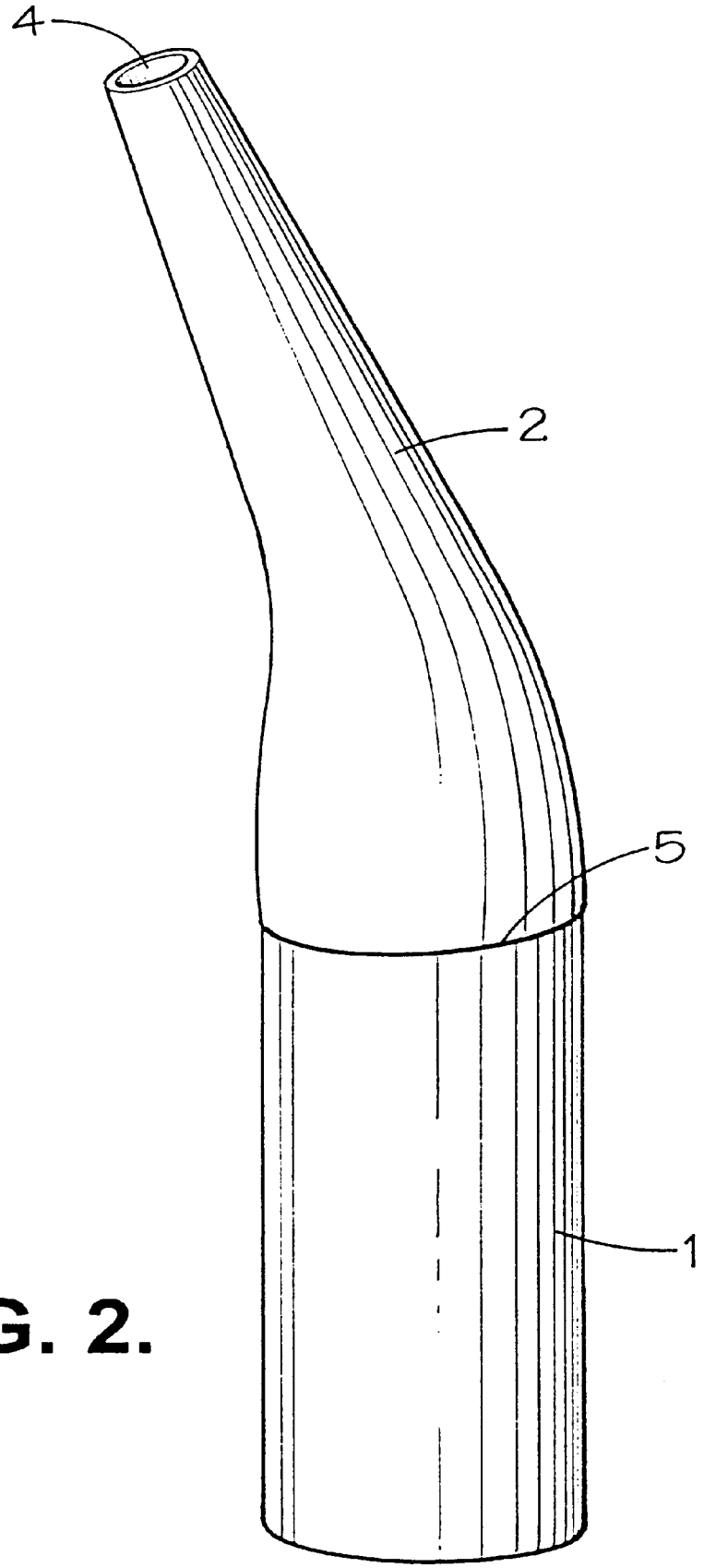
FIG. 2 shows first and second parts of the container joined together.

FIG. 1 shows the first part 1 and the second part 2. The first part 1 holds the fuel system additive and has an open end which is sealed using a hexagonal nut 3. The hexagonal nut 3 is screwed on to the open end of the first part 1.

Figure 3:
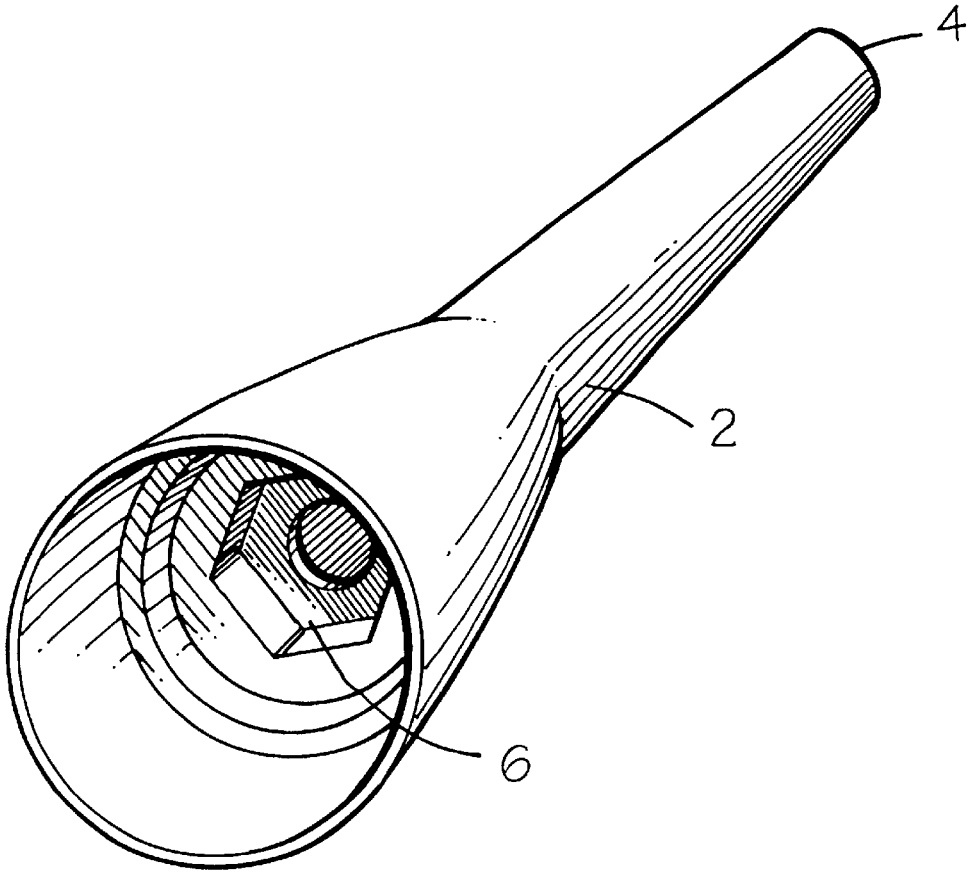
FIG. 3 shows the inside of the second part, looking into the wider end of the second part.

The second part 2 is capable of opening the flap of a fuel tank. The second part 2 is funnel-shaped with a spout end 4 and a wider end 5. The wider end 5 has a receiving member 6 which is shaped to receive the hexagonal nut 3. The receiving member 6 is shown in FIG. 3.

When the receiving member 6 receives the hexagonal nut 3, twisting of the two parts, the first part and the second part, relative to each other causes the hexagonal nut to be unscrewed from part 1, and thereby unseal part 1. Once part 1 has been unsealed, the fuel system additive can be poured into a fuel tank.

Since part 1 of the container is unsealed remotely, the risk of spillage of the fuel system additive is significantly reduced.

The container can be used by, for example, using one of the following two methods:

- inserting the spout end 4 of part 2 into a fuel tank of a vehicle to open the flap of the fuel tank;
- inserting the sealed end of part 1 into the wider end 5 of part 2 so that the receiving member 6 of part 2 receives the hexagonal nut 3 of part 1;
- twisting the two parts relative to each other so that the hexagonal nut 3 is unscrewed and part 1 is unsealed; and
- causing or allowing the fuel system additive in part 1 of the container, which is now unsealed, to pass through part 2 of the container and into the fuel tank; or inserting the sealed end of part 1 of the container into the wider end 5 of part 2 so that the receiving member 6 of part 2 receives the hexagonal nut 3 of part 1;

twisting the two parts relative to each other so that the hexagonal nut 3 is unscrewed and part 1 is unsealed;

inserting the spout end 4 of part 2 into a vehicle's fuel tank to open the flap on the fuel tank; and causing or allowing the fuel system additive in part 1 of the container, which is now unsealed, to pass through part 2 of the container and into the fuel tank.

What is claimed is:

1. A container for a fuel system additive, the container comprising:

a sealable first part for storing the fuel system additive; and a second part that is capable of opening a flap on the vehicle's fuel tank;

wherein the first part has a sealable open end and a lid which is capable of sealing the sealable open end; and the second part has a receiving member which is shaped to receive the lid and lock the two parts together; such that when the receiving member receives the lid, relative movement of the two parts is capable of unsealing the first part so that the fuel system additive can leave the first part and travel through the second part into a vehicle's fuel tank.

2. A container as claimed in claim 1, wherein the lid is a screw lid.

3. A container as in claim 2, wherein the lid is a nut.

4. A container as claimed in claim 1, wherein the second part is funnel-shaped having a spout end and a wider end.

5. A container as claimed in claim 3, wherein the second part is funnel-shaped having a spout end and a wider end.

6. A container as claimed in claim 2, wherein the second part is funnel-shaped having a spout and a wider end.

7. A container as claimed in claim 1, wherein the first and second parts are formed from molded plastics.

8. A container as claimed in claim 3, wherein, when the receiving member receives the nut, twisting of the two parts relative to each other causes the nut to be unscrewed from the first part, thereby unsealing the first part.

9. A container as claimed in claim 5, wherein, when the receiving member receives the nut, twisting of the two parts relative to each other causes the nut to be unscrewed from the first part, thereby unsealing the first part.

10. A method for filling a vehicle's tank with a fuel system additive, the method comprising the step of pouring a fuel additive system into the tank using the container claimed in claim 1.

11. A method for filling a vehicle's tank with a fuel system additive, using the container claimed in claim 9, which method comprises the steps of:

inserting the spout end of the second part into a fuel tank of a vehicle to open the flap of the fuel tank;

inserting the sealable open end of the first part into the wider end of the second part so that the receiving member of the second part receives the nut of the first part, twisting the two parts relative to each other so that the nut is unscrewed and the first part is unsealed, and causing the fuel system additive in the first part to pass through the second part into the fuel tank.

12. A container as in claim 3, wherein the nut is a hexagonal nut.

* * * * *